US009318807B2

(12) United States Patent
McCarrick et al.

(10) Patent No.: US 9,318,807 B2
(45) Date of Patent: Apr. 19, 2016

(54) STACKED SEPTUM POLARIZER AND FEED FOR A LOW PROFILE REFLECTOR

(71) Applicant: Micro-Ant, LLC, Jacksonville, FL (US)

(72) Inventors: Charles McCarrick, Jacksonville, FL (US); James D. Francis, Jacksonville, FL (US)

(73) Assignee: Micro-Ant, LLC, Jacksonville, FL (US)

( * ) Notice: Subject to any disclaimer, the term of this patent is extended or adjusted under 35 U.S.C. 154(b) by 0 days.

(21) Appl. No.: 14/659,597

(22) Filed: Mar. 16, 2015

(65) Prior Publication Data

US 2016/0020520 A1 Jan. 21, 2016

Related U.S. Application Data

(60) Provisional application No. 62/026,600, filed on Jul. 18, 2014.

(51) Int. Cl.

| | |
|---|---|
| ***H01Q 13/02*** | (2006.01) |
| ***H01Q 15/24*** | (2006.01) |
| ***H01Q 19/19*** | (2006.01) |

(52) U.S. Cl.
CPC ..... *H01Q 13/0241* (2013.01); *H01Q 13/0258* (2013.01); *H01Q 15/24* (2013.01); *H01Q 19/191* (2013.01)

(58) Field of Classification Search
CPC ..... H01P 5/12; H01P 5/18; H01P 5/181; H01P 5/182; H01Q 13/0241; H01Q 19/17
USPC ..... 333/21 A, 113, 117, 125, 137
See application file for complete search history.

(56) References Cited

U.S. PATENT DOCUMENTS

2008/0062056 A1* 3/2008 Hoferer ..... H01P 1/161 343/776
2013/0076583 A1* 3/2013 Iredale ..... H01Q 1/247 343/776

* cited by examiner

*Primary Examiner* — Robert Karacsony
(74) *Attorney, Agent, or Firm* — Mark Young, P.A.

(57) ABSTRACT

A low profile antenna assembly for an aircraft radome includes a reflector, a feed with a stacked array of septum polarizers, a mount, and a bracket. The feed, which includes bandpass and low pass filters, and broadwall branchline couplers, and the stacked array of septum polarizers, together determine polarization of the waves, attenuating unwanted signals and illuminating the entire reflector. The reflector comprises a portion of a parabolic reflector.

17 Claims, 14 Drawing Sheets

STACKED SEPTUM POLARIZER AND FEED FOR A LOW PROFILE REFLECTOR

RELATED APPLICATION

This application is a non-provisional and claims the benefit of priority of U.S. provisional application 62/026,600 entitled "Stacked Septum Polarizer and Feed for a Low Profile Reflector."

FIELD OF THE INVENTION

This invention relates generally to antennae, and, more particularly, to an antenna with a low profile high aspect ratio reflector, focal point less than 12", a surface suitable for Ka-band transmit and receive operations, and a feed with stacked septum polarizers that provide high gain and low sidelobes.

BACKGROUND

Constructed of material that minimally attenuates an electromagnetic signal transmitted or received by an antenna, an aircraft radome provides a radiolucent (i.e. rf transparent) weatherproof aerodynamic fairing. Radomes often appear as dome-like blisters on the fuselage of aircraft. To minimize drag, such radomes typically have a low profile, providing extremely limited space for an antenna and its related equipment. A contained antenna may be used for air to ground, satellite or aircraft-to-aircraft communication.

Heretofore, antennae having parabolic reflectors have been avoided in such aircraft radome applications, due to space constraints. Such limited space makes it difficult to illuminate the entire reflector surface, when the aspect ratio of the reflector is high and the feed is positioned only a short distance away.

Forgoing antennae having parabolic reflectors, antenna arrays comprising an array of flat panels have been devised to fit within aircraft radomes. While such high aspect ratio antennas provide adequate gain to close a communication link, they experience low aperture efficiencies and high sidelobe levels and grating lobes in some locations. High sidelobes and grating lobes are undesirable features of the solutions, with sidelobes representing unwanted radiation in undesired directions becoming a potential cause of interference and reduced signal to noise ratio. A spatial aliasing effect may cause some sidelobes to become substantially larger in amplitude, and approaching the level of the main lobe. Such sidelobes are called grating lobes. The efficiency of these antennas can be lowered due to the losses of beamformer networks required to feed the array elements.

By way of example, in-flight broadband connectivity and wireless in-flight entertainment for commercial aircraft, including Southwest Airlines, is provided using a Ku-band antenna system, comprised of a flat panel array, mounted atop the aircraft fuselage and encased within an RF-transparent radome. Such antenna systems communicate with geostationary satellites, allowing uninterrupted in-flight Wi-Fi service over water and on airlines' routes virtually anywhere in the world. Low aperture efficiencies, high sidelobes, grating lobes and losses of beamformer networks, and heavy weights compromise performance of such antenna systems.

The invention is directed to overcoming one or more of the problems and solving one or more of the needs as set forth above.

SUMMARY OF THE INVENTION

To solve one or more of the problems set forth above, in an exemplary implementation of the invention, an antenna assembly for an aircraft radome includes a reflector, a feed with a stacked array of septum polarizers, a mount, and a positioner. The feed, which includes bandpass and low pass filters, and broadwall branchline couplers, and the stacked array of septum polarizers, together determine polarization of the waves, attenuating unwanted signals and illuminating the entire reflector. The reflector comprises a portion of a parabolic reflective surface.

Focusing on an exemplary feed for a low profile antenna according to principles of the invention, an array of septum polarizers, namely, at least a first septum polarizer and a second septum polarizer, is provided. The first septum polarizer has a first stepped septum in a first feed horn port, and the second septum polarizer has a second stepped septum in a second feed horn port. The second feed horn port is adjacent and parallel to the first feed horn port. The first stepped septum is orthogonal to the second stepped septum.

A manifold is operably coupled to the first feed horn port and the second feed horn port. The manifold has a left transmit port permitting left circular polarization transmission, a right transmit port permitting right circular polarization transmission, a left receive port permitting left circular polarization reception and a right receive port permitting right circular polarization reception. The left receive port and left transmit port are coupled to the first feed horn port by a first left communication path including a first left waveguide. The right receive port and right transmit port are coupled to the first feed horn port by a first right communication path including a first right waveguide.

Filters separate transmit and receive frequencies. A left stub loaded bandpass filter is operably coupled to the left receive port. The left stub loaded bandpass filter filters (i.e., removes) transmit frequencies. A right stub loaded bandpass filter is operably coupled to the right receive port. The right stub loaded bandpass filter filters transmit frequencies.

A left tee-junction and a right tee junction are also provided. The left transmit port is coupled to the first left waveguide by the left tee-junction. The right transmit port is coupled to the first right waveguide by the right tee-junction. A left low pass filter between the left tee junction and left transmit port filters receive frequencies communicated through the left tee junction before reaching the left transmit port. Similarly, a right low pass filter between the right tee junction and right transmit port filters receive frequencies communicated through the right tee junction before reaching the right transmit port.

A second left waveguide and a second right waveguide are provided. The second left waveguide is joined to the first left waveguide by a left splitter. The second right waveguide is joined to the first right waveguide by a right splitter. The left and right splitters may comprise left and right broadwall couplers, respectively.

The second waveguides have terminated ends. Specifically, the second left waveguide has a left port end extending to the second feedhorn port and a loaded terminated end opposite the left port end. Similarly, the second right waveguide has a right port end extending to the first feedhorn port and a loaded terminated end opposite the right port end.

The feed, which has a phase center, may be used with a single reflector, or with multiple reflectors, such as in a Gregorian or Cassegrain configuration. When used with a single reflector, the phase center of the feed is located at about the focal point of the reflector. The reflector is less than twelve inches, preferably about nine inches, from the feed. The feed and reflector may be contained in a low profile aircraft radome. An exemplary reflector has a reflective surface shape comprising a portion of a parabola having a ratio of focal length to diameter equal to about 0.269 and a diameter equal to about 33.5".

Dimensional changes may be made to the waveguides to accommodate signals having different frequency bands. For example, in one exemplary implementation, the waveguides may be generally rectangular and have a 2:1 aspect ratio, i.e., a broad wall that is twice the dimension of the narrow wall, or very nearly so. The greater the size of the waveguide, the lower the frequency it communicates effectively. A rectangular waveguide having dimensions of approximately 0.622×0.311 inches may be suitable for Ku band communications operating at 12.4 to 18.0 GHz, while a waveguide having dimensions of approximately 0.280×0.140 inches may be suitable for Ka band communications operating at 26.5 to 40.0 GHz. In the case of a circular waveguide, the diameter may be about 0.500 to 0.688 inches for Ku band (12.4 to 18.0 GHz), and 0.219 to 0.315 inches for Ka band (26.5 to 40 GHz), depending upon the particular frequency.

In an implementation with two reflectors, including a primary reflector and a secondary reflector, the secondary reflector is in front of and aimed at the primary reflector, and the feed is behind the primary reflector and aimed at the secondary reflector. The secondary reflector may be a concave or convex reflector.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

The feed arm 105 is designed for feed 120 focusing and optimization. The feed arm 105 is a mechanical coupling to which the feed 120 and reflector 110 are attached. A positioner 130 connects the feed 120 to the feed arm 105. The feed arm 105 positions the phase center of the feed 120 at the focal point of the reflector 110.

RF energy from the feed 120 located at the reflector's focal point, reflects from the reflector 110 as narrow beams through parallel paths. All reflected rays from the feed 120 to a common plane have the same path length, create a coherent beam, and arrive in-phase. Characteristics of the incoming rays, are the reciprocal of the behavior of the reflected rays. The exemplary reflector 110 comprises an upper portion from a specific area of a larger parabolic surface, to optimize the RF performance and minimize RF blockage. More specifically, the exemplary reflector 110 comprises a portion from a larger parabolic surface. In one embodiment, the surface has a ratio of focal length to diameter (F/D) equal to about 0.269 and a diameter equal to about 33.5", to avoid blockage and reduce unwanted scattering. The F/D and diameter could be varied for a particular set of constraints. The overall reflector geometry is shaped to fit within the space available in the radome of an aircraft including azimuth and elevation travel ranges. The phase center of the feed 120 is located at the focal point of the reflector 110.

Figure 2:
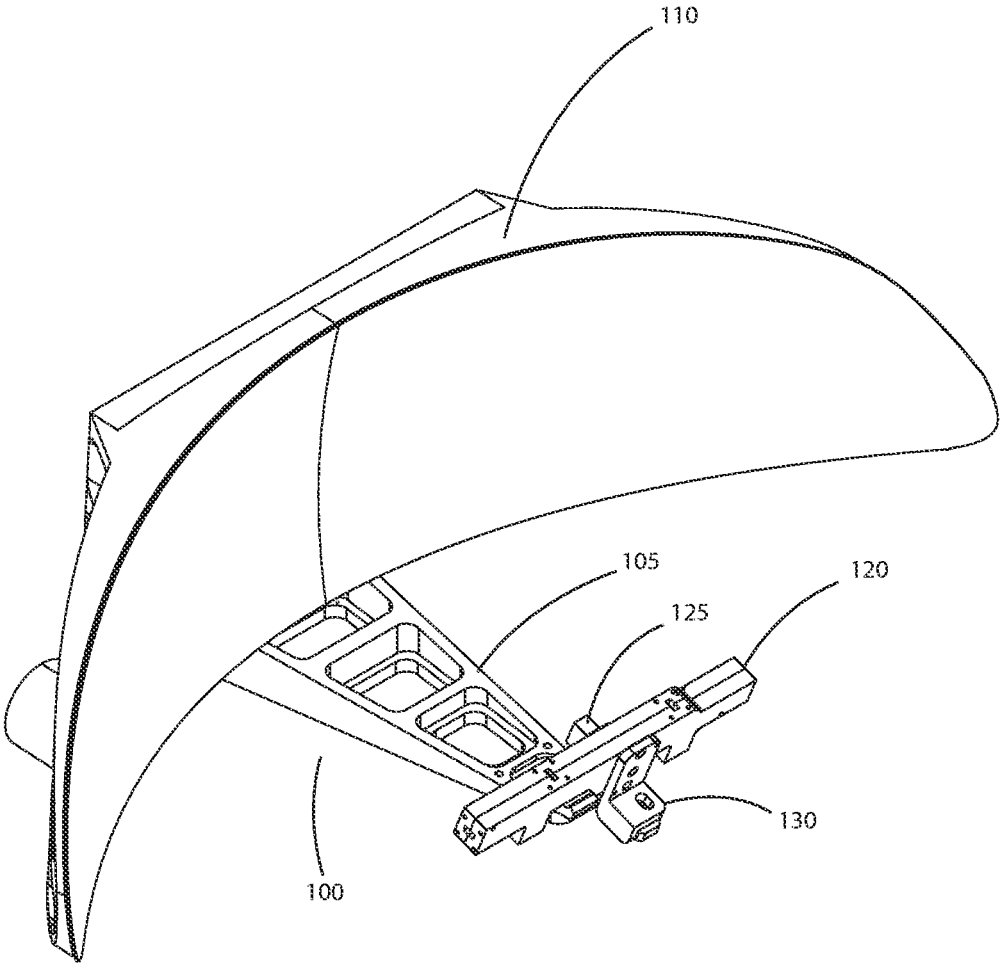
FIG. 2 provides a perspective view of the exemplary antenna assembly according to principles of the invention.
Figure 3:
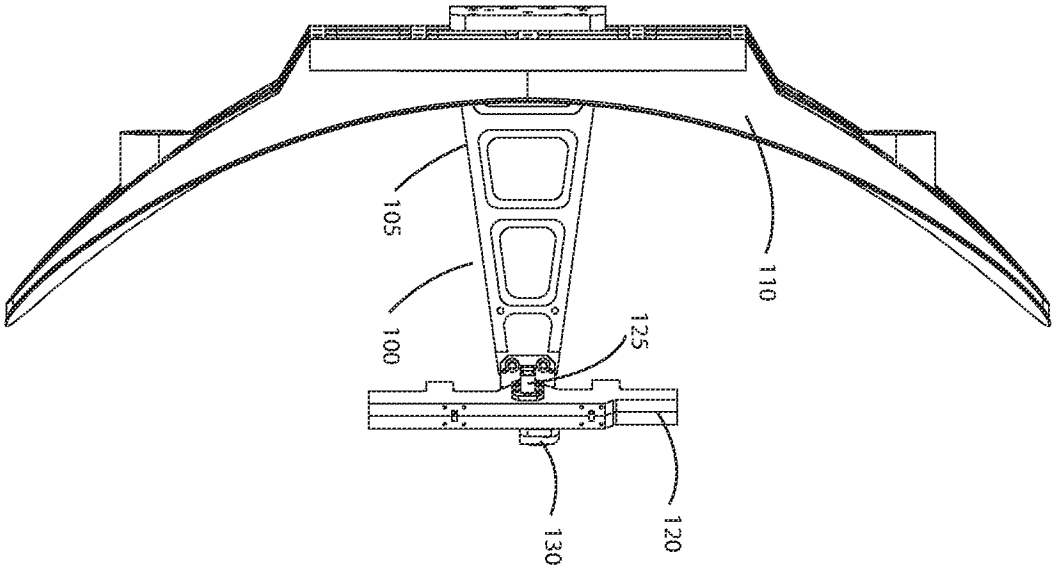
FIG. 3 provides a plan view of the exemplary antenna assembly according to principles of the invention.

In the perspective view of FIG. 2, and the plan view of FIG. 3, the spacing of the feed 120 relative to the reflector 110 is better illustrated. The feed 120 is located between the sides of the reflector 110 at the focal point of the reflector 110, which is in relative close proximity, i.e., about 9 inches from the reflector surface. This close proximity enables the assembly 100 to fit within the limited space of an aircraft radome. Yet, the feed 120 still illuminates the entire reflector and receives RF waves from the entire reflector. This remarkably close proximity is achievable only as a result of the feed 120 configuration, as described in greater detail below. The exemplary feed 120 accurately maps the amplitude and phase from the feed 120 to the reflector 110. The feed can comprise one or more horns. Accurate phase and amplitude mapping by the feed 120 is essential to achieve the high aperture efficiency, high gain and low sidelobe performance.

Figure 1:
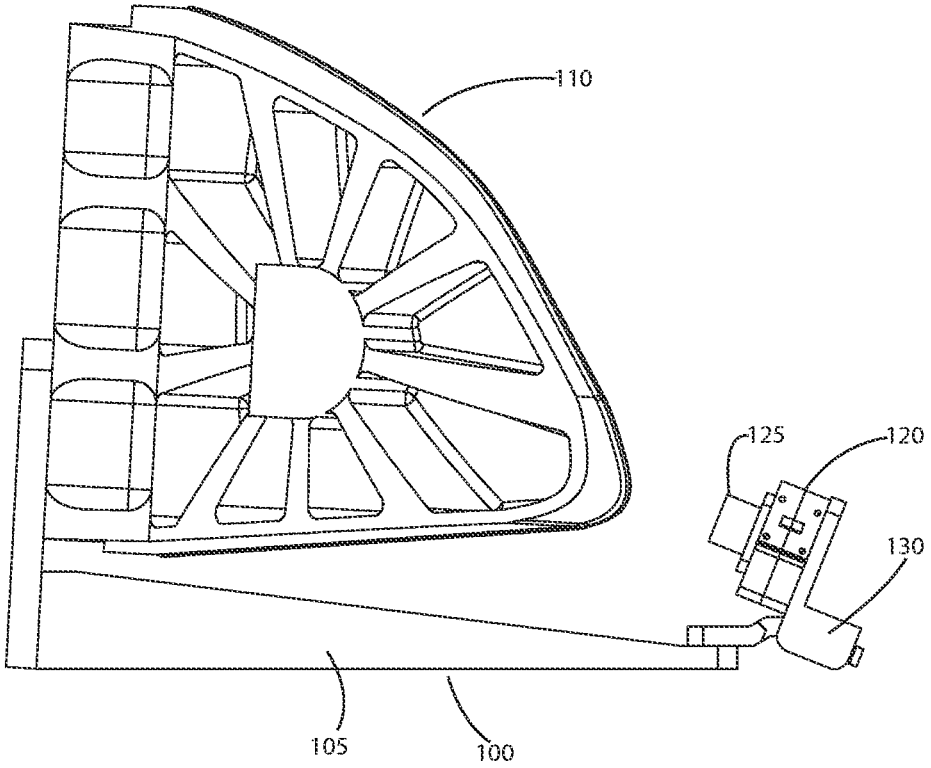
FIG. 1 provides a side view of an exemplary antenna assembly according to principles of the invention.
Figure 4:
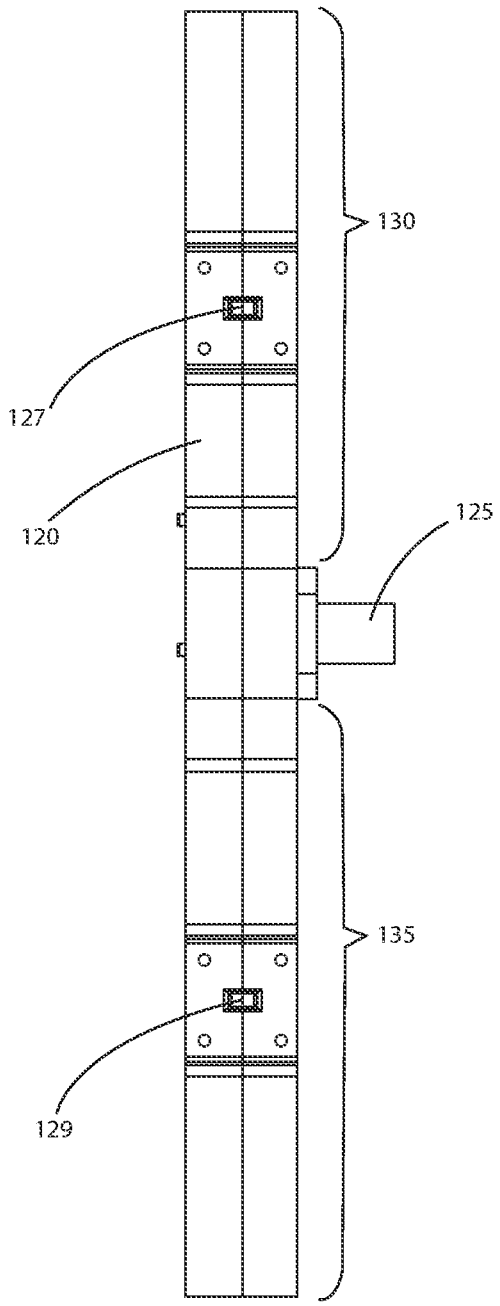
FIG. 4 provides a plan view of an exemplary feed source for an antenna assembly according to principles of the invention.
Figure 5:
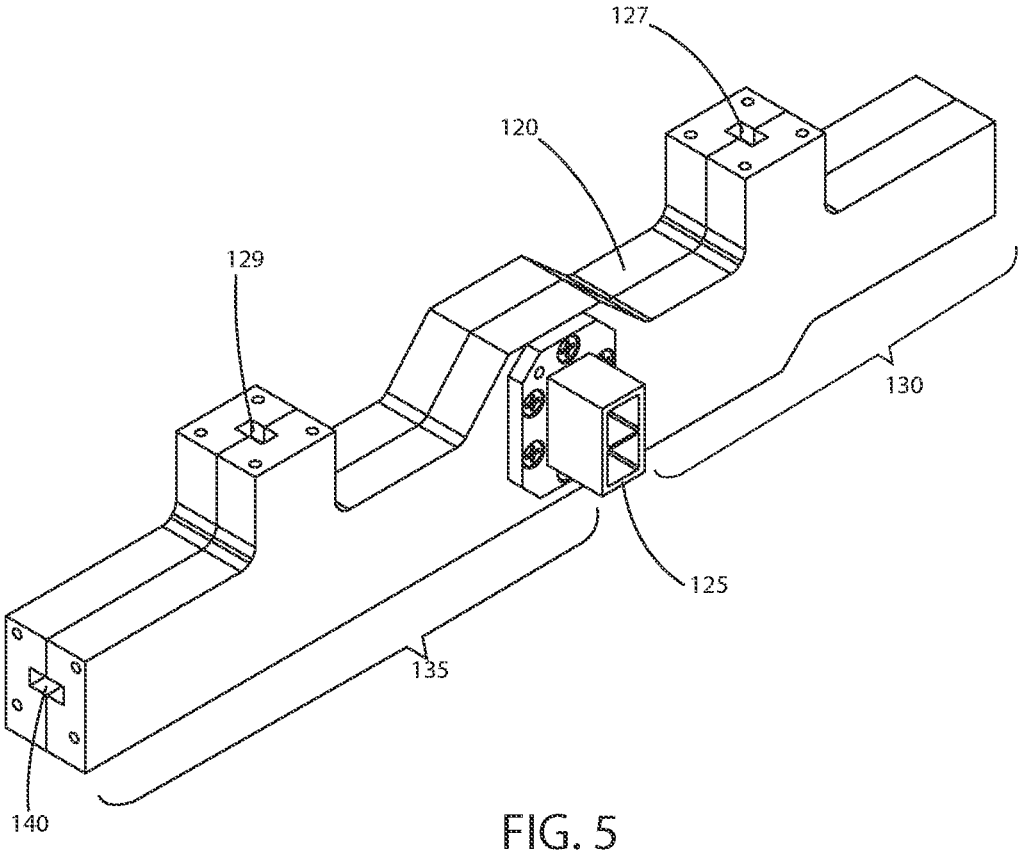
FIG. 5 provides a perspective view of the exemplary feed source for an antenna assembly according to principles of the invention.
Figure 6:
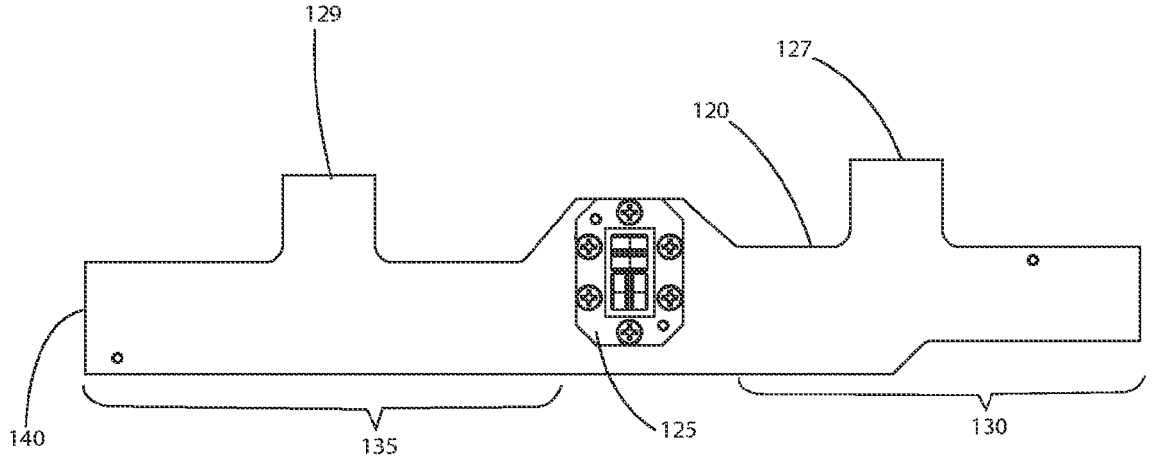
FIG. 6 provides a front view of the exemplary feed source for an antenna assembly according to principles of the invention.

Referring now to FIGS. 4 through 6, various views of the exterior of an exemplary feed 120 for an antenna assembly 100 according to principles of the invention are provided. Aesthetic features are not considered important. The exemplary feed 120 a left hand side 130 with a left hand circular polarization (LHCP) transmit (TX) port 127, and a right hand side 135 with a right hand circular polarization (RHCP) transmit (TX) port 129. Likewise, the feed 120 includes a left hand circular polarization (LHCP) receive (RX) port 145, and an opposite right hand circular polarization (RHCP) transmit (RX) port 140. The transmit ports 127, 129 may each comprise a microwave WR28 port, while the receive ports 140, 145 may each comprise a microwave WR42 port. The two transmit ports 127, 129 and two receive ports 140, 145, permit two circular polarizations each, RHCP and LHCP. Thus, an operation configuration matrix is achieved, as conceptually illustrated below, in table 1:

FIG. 1 provides a side view of an exemplary antenna assembly 100 according to principles of the invention. The assembly 100 includes a reflector 110, a feed 120 with a stacked array of septum polarizers 125, a feed arm 105, and a positioner 130. The feed 120 (aka, feed horn or feed source) conveys radio waves between the transmitter and receiver and the reflector. The feed 120 also determines the polarization of the waves to be received, which helps to attenuate unwanted signals. The feed 120 comprises a diplexer providing separate propagation paths for electromagnetic radiations of different polarizations, such as one branch for left hand circular polarization and another branch for right hand circular polarization, and each branch including separate waveguides for received and transmitted radiations. When used with a parabolic reflector, the phase center of the feed is placed at the focal point of the reflector.

TABLE 1

| POLARIZATION BAND | |
|---|---|
| TX | RX |
| RH | LH |
| LH | RH |

Figure 7:
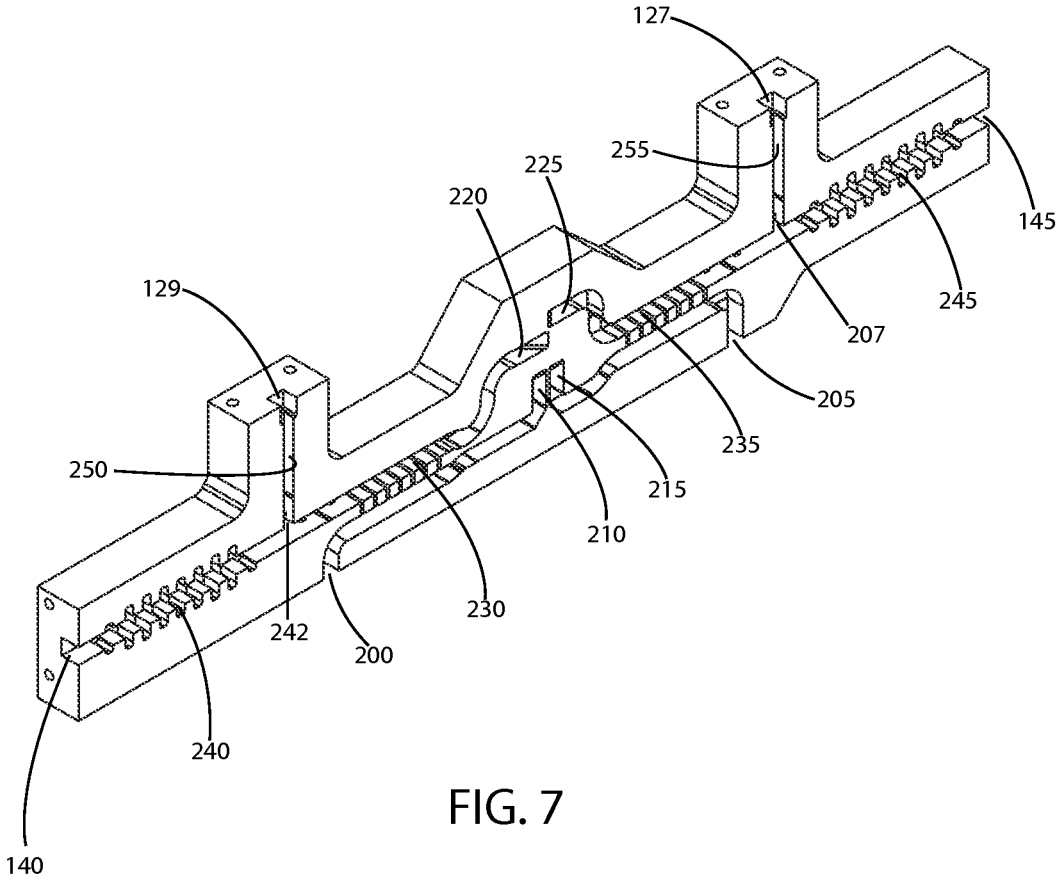
FIG. 7 provides a perspective view of an exemplary manifold of the exemplary feed source for an antenna assembly according to principles of the invention.
Figure 8:
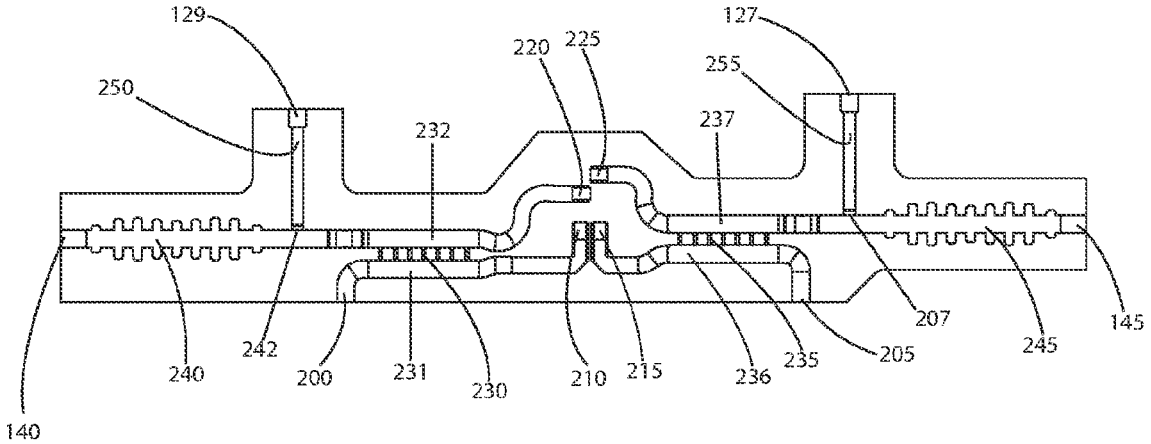
FIG. 8 provides a front view of the exemplary manifold for the exemplary feed source for an antenna assembly according to principles of the invention.
Figure 9:
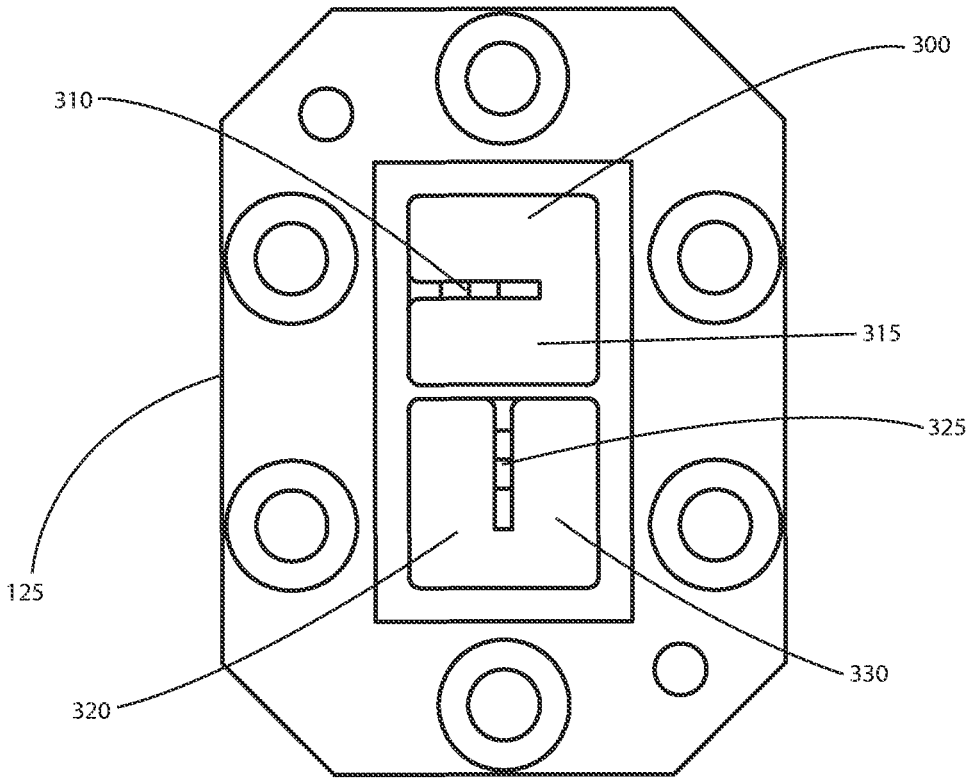
FIG. 9 provides a front view of an exemplary stacked array of septum polarizers for the exemplary feed source for an antenna assembly according to principles of the invention.
Figure 10:
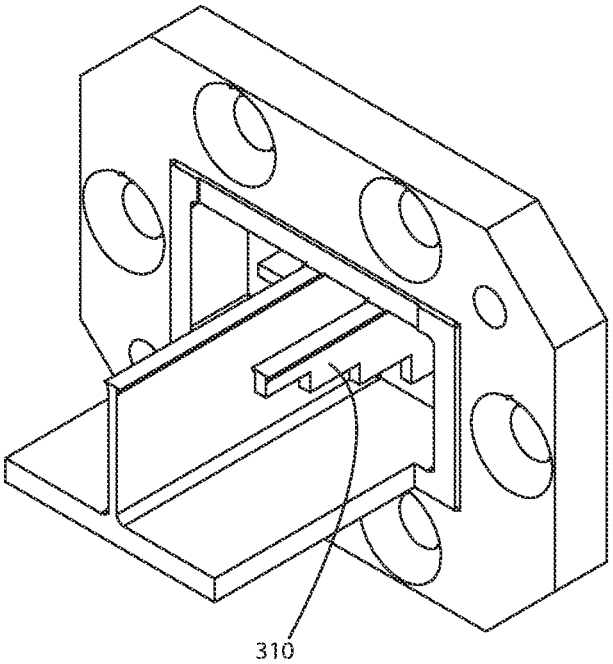
FIG. 10 provides a first perspective view of the exemplary stacked array of septum polarizers with a sidewall removed to reveal stepped septa for an antenna assembly according to principles of the invention.
Figure 11:
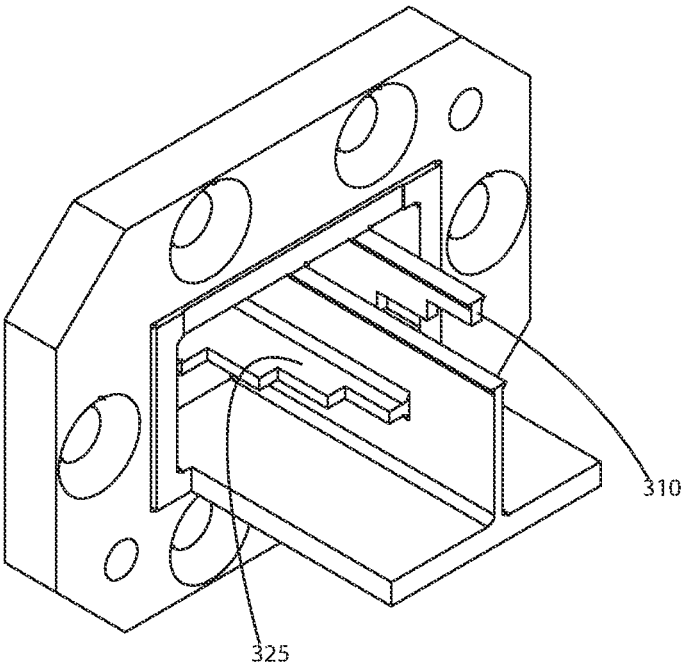
FIG. 11 provides a second perspective view of the exemplary stacked array of septum polarizers with a sidewall removed to reveal stepped septa for an antenna assembly according to principles of the invention.
Figure 12:
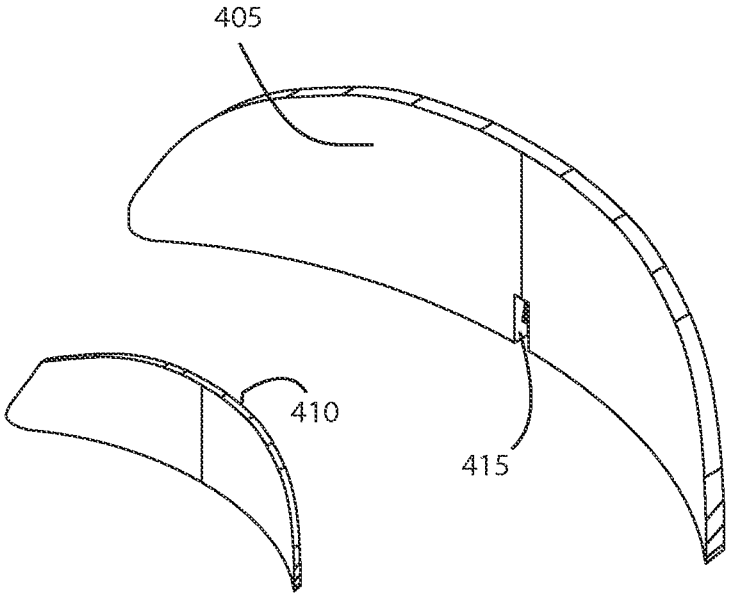
FIG. 12 provides a perspective view of an exemplary offset Cassegrain antenna configuration with an exemplary stacked septum polarizer and feed for a low profile reflector according to principles of the invention.
Figure 13:
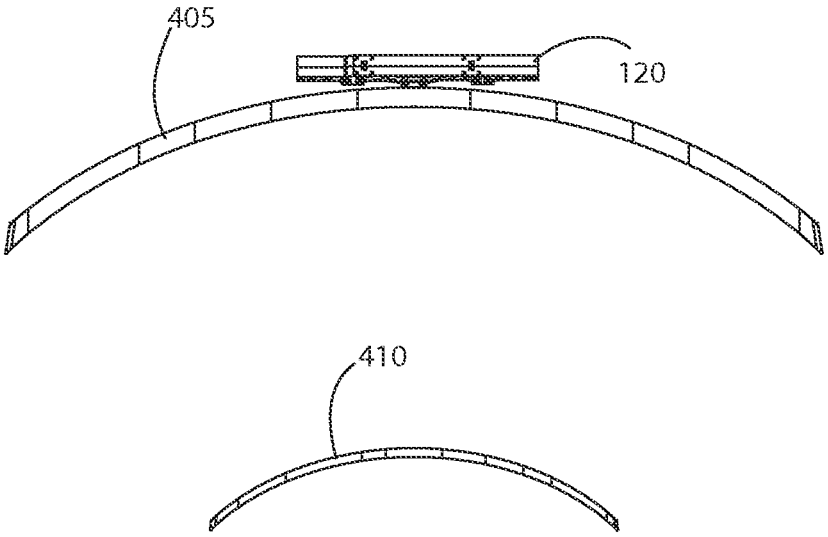
FIG. 13 provides a plan view of an exemplary offset Cassegrain antenna configuration with an exemplary stacked septum polarizer and feed for a low profile reflector according to principles of the invention.
Figure 14:
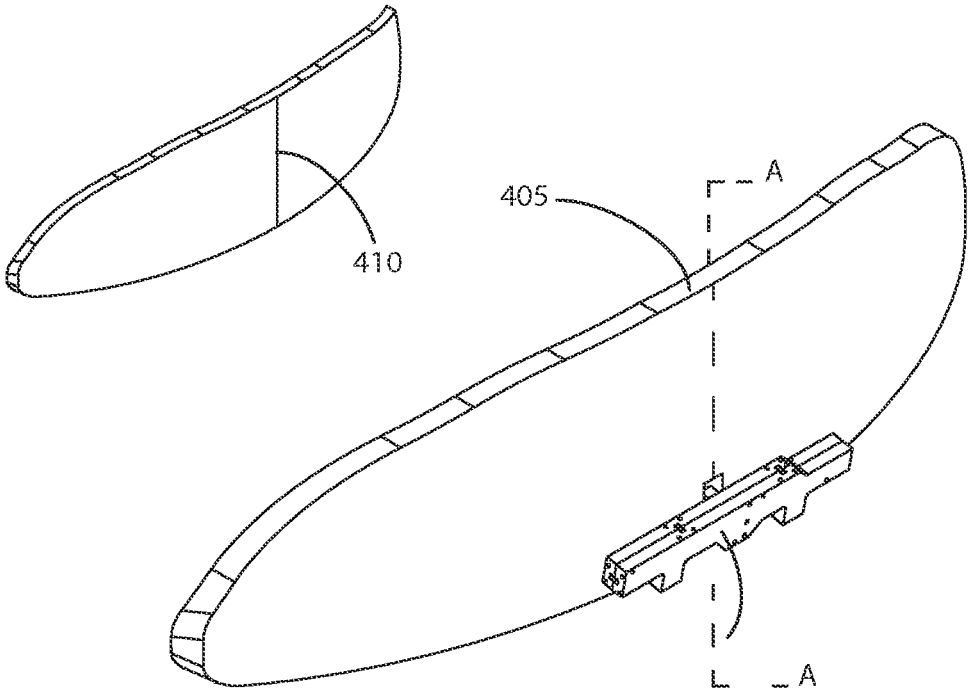
FIG. 14 provides another perspective view of an exemplary offset Cassegrain antenna configuration with an exemplary stacked septum polarizer and feed for a low profile reflector according to principles of the invention.
Figure 15:
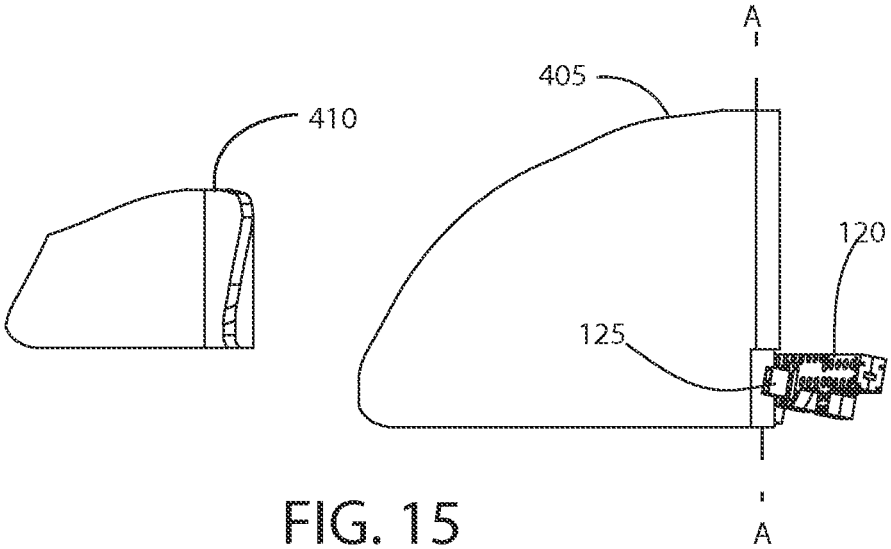
FIG. 15 provides a perspective view of an exemplary offset Cassegrain antenna configuration with a portion of the primary reflector cut away to more clearly reveal an exemplary stacked septum polarizer and feed for a low profile reflector according to principles of the invention.
Figure 16:
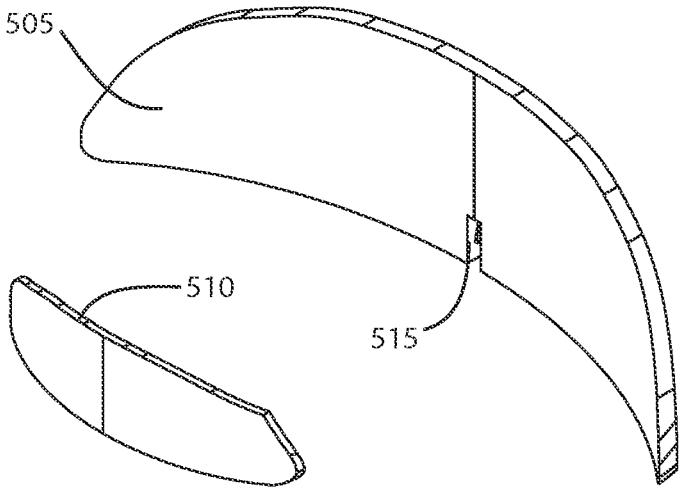
FIG. 16 provides a perspective view of an exemplary offset Gregorian antenna configuration with an exemplary stacked septum polarizer and feed for a low profile reflector according to principles of the invention.
Figure 17:
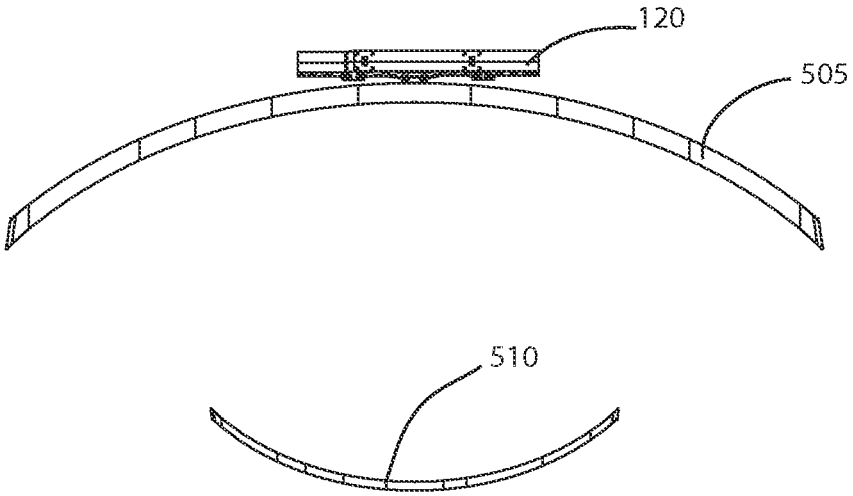
FIG. 17 provides a plan view of an exemplary offset Gregorian antenna configuration with an exemplary stacked septum polarizer and feed for a low profile reflector according to principles of the invention.
Figure 18:
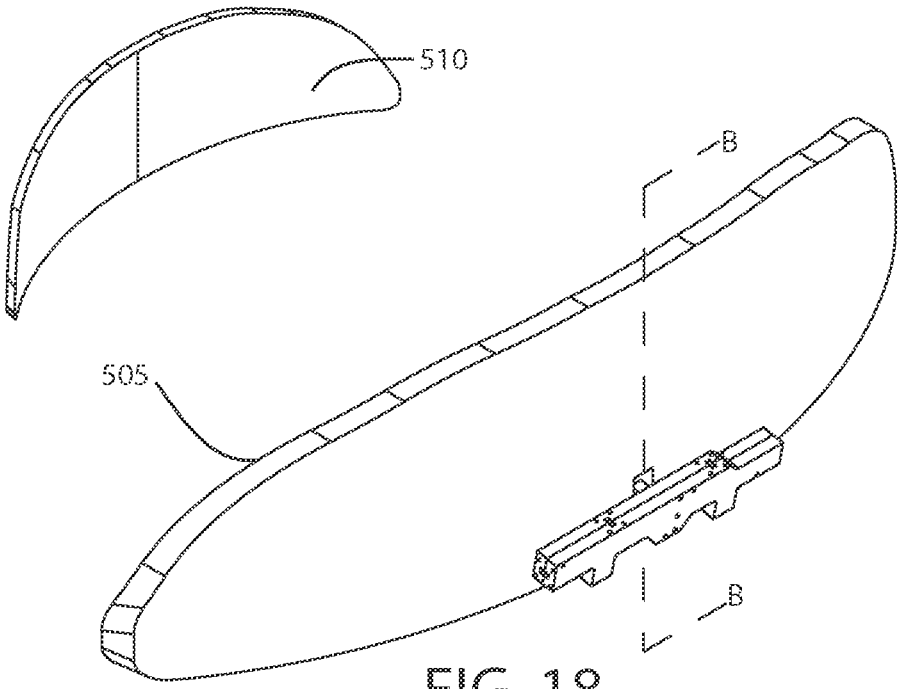
FIG. 18 provides another perspective view of an exemplary offset Gregorian antenna configuration with an exemplary stacked septum polarizer and feed for a low profile reflector according to principles of the invention.
Figure 19:
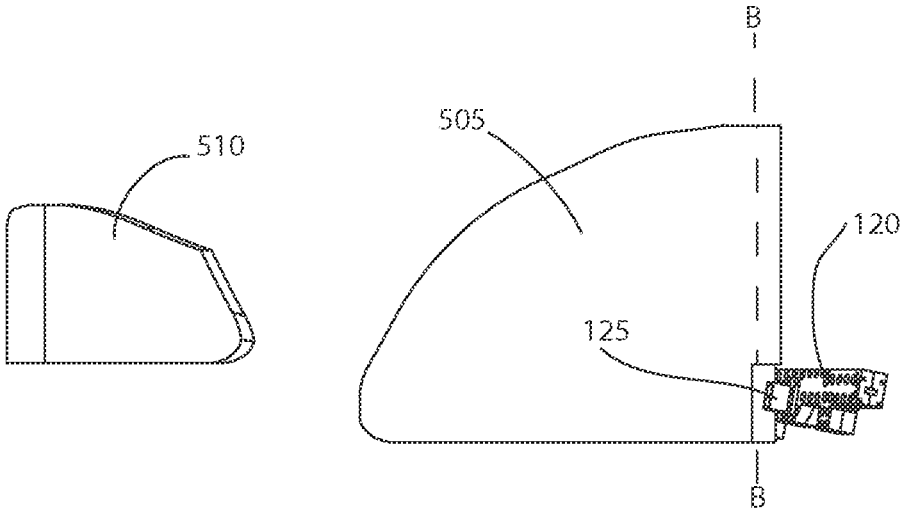
FIG. 19 provides a perspective view of an exemplary offset Gregorian antenna configuration with a portion of the primary reflector cut away to more clearly reveal an exemplary stacked septum polarizer and feed for a low profile reflector according to principles of the invention.

Now, with reference to FIGS. 7 and 8, perspective and frontal views of an exemplary manifold of the exemplary feed 120 for an antenna assembly 100 according to principles of the invention are provided. The manifold includes interfaces 210, 215, 220, 225, to the array of septum polarizers, which are described below, as illustrated in FIGS. 9 through 11. Interface 210 is coupled to waveguide port 320 of the array. Interface 215 is coupled to waveguide port 330 of the array. Interface 220 is coupled to waveguide port 315 of the array. Interface 225 is coupled to waveguide port 300 of the array. Thus, each interface 210, 215, 220, 225 is coupled to a waveguide port of the array. Interfaces 220 and 225 comprise match terminated sections of branch line isolation ports.

A pair of waveguide broadwall couplers 230, 235 are provided. Two waveguides (i.e., branchlines) share a broad wall on each side (LH and RH) of the manifold. Holes are provided in the broad wall to couple the waveguides. In an exemplary implementation, the holes may be ¼ wave apart. In a forward case the coupled signals add, in the reverse they may subtract (180 apart) and disappear. A right hand waveguide broadwall coupler 230 couples branchlines 231 and 232. A left hand waveguide broadwall coupler 235 couples branchlines 236 and 237.

An e-plane waveguide tee junction 207, 242 connects each branchline 232, 237 to a transmit port, LHCP TX port 127 and RHCP TX port 129 via waveguide transitions 250, 255. One tee junction 207 is provided on the left side and the other 242 on the right side.

A waveguide stub loaded bandpass filter 240, 245 is attached to each receive port 140, 145 to reject transmit (TX) frequencies. Specifically, filter 240 filters transmit frequencies for port 140, while filter 245 filters transmit frequencies for port 145.

Waveguide transitions 250, 255, each comprise a waveguide squeeze section low pass filter for each transmit port 129, 127 to reject receive (RX) frequencies. Specifically, filter 250, filters receive frequencies for port 129, while filter 255 filters transmit frequencies for port 127.

Branchlines 231 and 236 lead, at one end, to loaded terminated ports 200, 205, respectively. At the opposite ends, the branchlines 231, 236 lead to interfaces 210, 215, respectively. Thus, the feed 120 provides two left hand and two right hand radiating elements, including one left hand and one right hand radiating element for each orthogonal septum polarizer.

Now referring to FIG. 9 a front view of an exemplary stacked array 125 of septum polarizers for the exemplary feed source 120 for an antenna assembly 100 according to principles of the invention. One end of the array is open and is located at the focal point of the reflector 110 to illuminate the reflector and receive waves reflected from the reflector 110. The opposite end is divided into a plurality of waveguide ports, including ports 300 and 315, and ports 320 and 330, each by a conducting septum 310, 325. The septa are arranged orthogonally, with the upper septum 310 rotated 90° relative to the lower septum 325. As better seen in the perspective views of FIGS. 10 and 11, where a wall of the array 125 has been removed to more clearly expose the shape of the septa, each septum 310, 325 features a stepped shape producing circular polarized fields. Each waveguide port is differentiated by polarity, e.g., right hand (RH) and left hand (LH). In this configuration, the stacked array of septum polarizers illuminate the reflector and function as a feed source.

The waveguides may be sized and shaped to accommodate signals having different frequency bands. For example, in one exemplary implementation, the waveguides may be generally rectangular and have a 2:1 aspect ratio, i.e., a broad wall that is twice the dimension of the narrow wall, or very nearly so. The greater the size of the waveguide, the lower the frequency it communicates effectively. A rectangular waveguide having dimensions of approximately 0.622×0.311 inches may be suitable for Ku band communications operating at 12.4 to 18.0 GHz, while a waveguide having dimensions of approximately 0.280×0.140 inches may be suitable for Ka band communications operating at 26.5 to 40.0 GHz. In the case of a circular waveguide, the diameter may be about 0.500 to 0.688 inches for Ku band (12.4 to 18.0 GHz), and 0.219 to 0.315 inches for Ka band (26.5 to 40 GHz), depending upon the particular frequency.

A stacked septum polarizer and feed for a low profile reflector according to principles of the invention may be utilized in single reflector (e.g., FIG. 1) or multiple reflector antenna systems (e.g., FIGS. 12 through 19), with the feed being offset or not. By way of example and not limitation, FIGS. 12 through 15 conceptually illustrate a Cassegrain implementation. A feed 120 according to principles of the invention is mounted at or behind a concave primary reflector 405 aimed at a smaller convex secondary reflector 410 in front of the primary reflector 405. A slot 415 or other window in the primary reflector 405 provides a communication path from the fee 120 to the secondary reflector 410. Alternatively, the feed may be positioned below or above the primary reflector 405, obviating the slot 415. A Cassegrain implementation may be configured according to principles of Cassegrain antenna design, including positioning the reflectors with the focal point of the primary reflector 405 about coincident with the focal point of the secondary reflector 410, and the feed being positioned in proximity of the focal point of the secondary reflector 410.

As another non-limiting example, FIGS. 16 through 19 conceptually illustrate a Gregorian implementation. A feed 120 according to principles of the invention is mounted at or behind a concave primary reflector 505 aimed at a smaller concave secondary reflector 510 in front of the primary reflector 505. A slot 515 or other window in the primary reflector 505 provides a communication path from the fee 120 to the secondary reflector 510. Alternatively, the feed may be positioned below or above the primary reflector 505, obviating the slot 515. As with a Cassegrain implementation, a Gregorian implementation may be configured according to principles of Gregorian antenna design, including positioning the reflectors with the focal point of the primary reflector 505 about coincident with the focal point of the secondary reflector 510, and the feed being positioned in proximity of the focal point of the secondary reflector 510.

Reflectors according to principles of the invention may be comprised of any suitable materials, including, but not limited to aluminum and graphite composite. By way of example, a light-weight graphite composite reflector may be utilized to facilitate positioning. Such a reflector may comprise a lightweight core, such as of honeycomb material, having graphite composite fabric reflector layers bonded to the opposed faces of the core. Such a reflector may constructed by laminating thin composite fabric reflector layers to a central reinforcing core of conventional lightweight honeycomb material, such as paper fiberboard, heat-resistant plastic, aluminum alloy, etc., by means of curable adhesive layers. The graphite composite reflective layers are comprised of graphite encapsulated within a cured plastic composition, such as polycyanate ester resin, epoxy resin or other curable polymer resin conventionally used to form fiber-reinforced composite fabrics conventionally used in the aviation industry. The various layers are superposed and heat-bonded to form a reflector laminate. The honeycomb core is formed in the desired size, shape or curvature, whereupon the outer reflector layers will conform to the surface shapes of the core to form the reflector. In alternative embodiments, a structural core may be comprised of laid up layers of graphite composite or other structural material suitable for fiber-reinforced composite fabrics construction in the aviation industry.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A feed for a low profile antenna comprising:

a stacked array of septum polarizers, including a first septum polarizer and a second septum polarizer, the first septum polarizer having a first stepped septum in a first feed horn port, and the second septum polarizer having a second stepped septum in a second feed horn port, the second feed horn port being adjacent and parallel to the first feed horn port and having a shared wall with the first feed horn port, and the first stepped septum being orthogonal to the second stepped septum, and the second stepped septum extending from the shared wall;

a manifold operably coupled to the first feed horn port and the second feed horn port, the manifold having a left transmit port permitting left circular polarization transmission, a right transmit port permitting right circular polarization transmission, a left receive port permitting left circular polarization reception and a right receive port permitting right circular polarization reception, the left receive port and left transmit port being coupled to the first feed horn port by a first left communication path including a first left waveguide, and the right receive port and right transmit port being coupled to the first feed horn port by a first right communication path including a first right waveguide;

a left tee-junction and a right tee-junction, the left transmit port being coupled to the first left waveguide by the left tee-junction, and the right transmit port being coupled to the first right waveguide by the right tee-junction;

a second left waveguide and a second right waveguide, the second left waveguide joined to the first left waveguide by a left splitter, and the second right waveguide joined to the first right waveguide by a right splitter;

the left splitter comprising a left broadwall coupler coupling the first left waveguide and the second left waveguide;

the right splitter comprising a right broadwall coupler coupling the first right waveguide and the second right waveguide;

the second left waveguide having a left port end extending to the second feedhorn port and a loaded terminated end opposite the left port end; and the second right waveguide having a right port end extending to the first feedhorn port and a loaded terminated end opposite the right port end.

2. The feed for a low profile antenna according to claim 1, further comprising a left stub loaded bandpass filter operably coupled to the left receive port, the left stub loaded bandpass filter filtering transmit frequencies.

3. The feed for a low profile antenna according to claim 2, further comprising a right stub loaded bandpass filter operably coupled to the right receive port, the right stub loaded bandpass filter filtering transmit frequencies.

4. The feed for a low profile antenna according to claim 3, further comprising a left low pass filter between the left tee junction and left transmit port, the left low pass filter filtering receive frequencies communicated through the left tee junction before reaching the left transmit port.

5. The feed for a low profile antenna according to claim 4, further comprising a right low pass filter between the right tee junction and right transmit port, the right low pass filter filtering receive frequencies communicated through the right tee junction before reaching the right transmit port.

6. The feed for a low profile antenna according to claim 1, the first right waveguide, first left waveguide, second right waveguide and second left waveguide being sized and shaped for a frequency of operation being one of Ka band and Ku band.

7. A low profile antenna comprising a feed, the feed comprising:

a stacked array of septum polarizers, including a first septum polarizer and a second septum polarizer, the first septum polarizer having a first stepped septum in a first feed horn port, and the second septum polarizer having a second stepped septum in a second feed horn port, the second feed horn port being adjacent and parallel to the first feed horn port and having a shared wall with the first feed horn port, and the first stepped septum being orthogonal to the second stepped septum, and the second stepped septum extending from the shared wall;

a manifold operably coupled to the first feed horn port and the second feed horn port, the manifold having a left transmit port permitting left circular polarization transmission, a right transmit port permitting right circular polarization transmission, a left receive port permitting left circular polarization reception and a right receive port permitting right circular polarization reception, the left receive port and left transmit port being coupled to the first feed horn port by a first left communication path including a first left waveguide, and the right receive port and right transmit port being coupled to the first feed horn port by a first right communication path including a first right waveguide;

a left stub loaded bandpass filter operably coupled to the left receive port, the left stub loaded bandpass filter filtering transmit frequencies;

a right stub loaded bandpass filter operably coupled to the right receive port, the right stub loaded bandpass filter filtering transmit frequencies;

a left tee-junction and a right tee-junction, the left transmit port being coupled to the first left waveguide by the left tee-junction, and the right transmit port being coupled to the first right waveguide by the left tee-junction;

a left low pass filter between the left tee junction and left transmit port, the left low pass filter filtering receive frequencies communicated through the left tee junction before reaching the left transmit port;

a right low pass filter between the right tee junction and right transmit port, the right low pass filter filtering receive frequencies communicated through the right tee junction before reaching the right transmit port;

a second left waveguide and a second right waveguide, the second left waveguide joined to the first left waveguide by a left splitter, and the second right waveguide joined to the first right waveguide by a right splitter, the left splitter comprising a left broadwall coupler coupling the first left waveguide and the second left waveguide, the right splitter comprising a right broadwall coupler coupling the first right waveguide and the second right waveguide, the second left waveguide having a left port end extending to the second feedhorn port and a loaded terminated end opposite the left port end, the second right waveguide having a right port end extending to the first feedhorn port and a loaded terminated end opposite the right port end; the feed having a phase center; and a reflector having a focal point, and the phase center of the feed being at about the focal point.

8. The low profile antenna according to claim 7, the reflector being less than twelve inches from the feed.

9. The low profile antenna according to claim 8, the reflector being about nine inches from the feed.

10. The low profile antenna according to claim 9, further comprising an aircraft radome containing the feed and reflector.

11. The low profile antenna according to claim 10, the reflector has a reflective surface shape comprising a portion of a parabola having a ratio of focal length to diameter equal to about 0.269 and a diameter equal to about 33.5".

12. The low profile antenna according to claim 11, the reflector comprising a material from the group consisting of aluminum and graphite.

13. The low profile antenna according to claim 7, the first right waveguide, first left waveguide, second right waveguide and second left waveguide being sized and shaped for a frequency of operation being one of Ka band and Ku band.

14. A low profile antenna system comprising a feed, the feed comprising:

a stacked array of septum polarizers, including a first septum polarizer and a second septum polarizer, the first septum polarizer having a first stepped septum in a first feed horn port, and the second septum polarizer having a second stepped septum in a second feed horn port, the second feed horn port being adjacent and parallel to the first feed horn port and having a shared wall with the first feed horn port, and the first stepped septum being orthogonal to the second stepped septum, and the second stepped septum extending from the shared wall;

a manifold operably coupled to the first feed horn port and the second feed horn port, the manifold having a left transmit port permitting left circular polarization transmission, a right transmit port permitting right circular polarization transmission, a left receive port permitting left circular polarization reception and a right receive port permitting right circular polarization reception, the left receive port and left transmit port being coupled to the first feed horn port by a first left communication path including a first left waveguide, and the right receive port and right transmit port being coupled to the first feed horn port by a first right communication path including a first right waveguide;

a left stub loaded bandpass filter operably coupled to the left receive port, the left stub loaded bandpass filter filtering transmit frequencies;

a right stub loaded bandpass filter operably coupled to the right receive port, the right stub loaded bandpass filter filtering transmit frequencies;

a left tee-junction and a right tee-junction, the left transmit port being coupled to the first left waveguide by the left tee-junction, and the right transmit port being coupled to the first right waveguide by the left tee-junction;

a left low pass filter between the left tee junction and left transmit port, the left low pass filter filtering receive frequencies communicated through the left tee junction before reaching the left transmit port;

a right low pass filter between the right tee junction and right transmit port, the right low pass filter filtering receive frequencies communicated through the right tee junction before reaching the right transmit port;

a second left waveguide and a second right waveguide, the second left waveguide joined to the first left waveguide by a left splitter, and the second right waveguide joined to the first right waveguide by a right splitter, the left splitter comprising a left broadwall coupler coupling the first left waveguide and the second left waveguide, the right splitter comprising a right broadwall coupler coupling the first right waveguide and the second right waveguide, the second left waveguide having a left port end extending to the second feedhorn port and a loaded terminated end opposite the left port end, the second right waveguide having a right port end extending to the first feedhorn port and a loaded terminated end opposite the right port end;

the feed having a phase center; and a primary reflector and a secondary reflector, the secondary reflector being in front of and aimed at the primary reflector, and the feed being behind the primary reflector and aimed at the secondary reflector.

15. The low profile antenna system according to claim 14, the secondary reflector being one of a concave reflector and a convex reflector.

16. The low profile antenna according to claim 15, at least one of the primary reflector and secondary reflector comprising a material from the group consisting of aluminum and graphite.

17. The low profile antenna system according to claim 16, the first right waveguide, first left waveguide, second right waveguide and second left waveguide being sized and shaped for a frequency of operation being one of Ka band and Ku band.

* * * * *